US005235247A

United States Patent [19]

Shishido et al.

[11] Patent Number: 5,235,247

[45] Date of Patent: Aug. 10, 1993

[54] DISCHARGE TUBE WITH ACTIVATION LAYER

[75] Inventors: Masataka Shishido; Takashi Sato; Takahisa Suzuki; Tetsuya Mitani; Hiromitsu Tsuchiya, all of Shizuoka, Japan

[73] Assignee: Yazaki Corporation, Tokyo, Japan

[21] Appl. No.: 758,140

[22] Filed: Sep. 12, 1991

[30] Foreign Application Priority Data

Sep. 25, 1990 [JP] Japan ..... 2-251950

[51] Int. Cl.[5] ..... H01J 61/35

[52] U.S. Cl. ..... 313/635; 313/325

[58] Field of Search ..... 313/635, 325

[56] References Cited

U.S. PATENT DOCUMENTS

| | | | |
|---|---|---|---|
| 1,968,822 | 8/1934 | Gaides et al. | 313/635 |
| 3,431,452 | 3/1969 | Hale et al. | 313/325 X |
| 4,091,436 | 5/1978 | Lange et al. | 313/325 X |
| 4,104,693 | 8/1978 | Toda et al. . | |

FOREIGN PATENT DOCUMENTS

| | | |
|---|---|---|
| 0249796 | 12/1987 | European Pat. Off. . |
| 1386946 | 3/1975 | United Kingdom . |
| 1469572 | 4/1976 | United Kingdom . |
| 1457723 | 12/1976 | United Kingdom . |
| 2046009 | 11/1980 | United Kingdom . |
| 2052188 | 1/1981 | United Kingdom . |
| 1591150 | 6/1981 | United Kingdom . |

*Primary Examiner*—Palmer C. Demeo

*Attorney, Agent, or Firm*—Nikaido, Marmelstein, Murray & Oram

[57] ABSTRACT

The discharge tube consists of an electrically insulating cylindrical body and a pair of electrodes disposed facing each other in the cylindrical body, and is sealed with an inert gas. An activation layer of a silicate compound of alkaline metal is formed over at least a part of the inner wall surface and the electrode surface, other than the discharge surface, that are exposed to the sealed gas. This activation layer helps keep the discharge inception voltage stable even when the discharge frequency changes greatly, which in turn extends the longevity of the discharge tube.

3 Claims, 2 Drawing Sheets

DISCHARGE TUBE WITH ACTIVATION LAYER

BACKGROUND OF THE INVENTION

1. Field of the Invention

The present invention relates to a gas-filled discharge tube used, for example, as a voltage control discharge tube, a gap switching discharge tube, and a sharpener gap.

2. Description of the Prior Art

The discharge tubes are employed in various equipment, as a self-exploded (self-propelled) gap switch in voltage controllers and pulse lasers or as a sharpener gap provided immediately before a triggered spark gap switch. There is a discharge tube suited for these uses which has discharge electrodes attached at the ends of a cylinder with an inert gas sealed therein.

In such discharge tubes, when the frequency of repetitive discharge (hereinafter referred to as a discharge frequency or simply as a frequency) is high, the discharge inception voltage generally converges to a certain value as shown in FIG. 4. As the discharge frequency lowers on the other hand, the discharge inception voltage tends to increase. With this kind of discharge tubes, it is not desirable that the discharge inception voltage changes according to the discharge frequency. It is desired that the frequency vs. discharge inception voltage characteristic be flat.

As a means to improve the frequency characteristic, it has been conceived to provide a trigger wire T, which has been used in arresters, as shown in FIG. 2. This, however, has a drawback. Since the trigger wire T is formed by drawing fine wires from the both electrodes to near the middle point in the tube by using a conductive carbon paint, flashovers easily occur along the cylindrical wall of such discharge tubes as voltage control discharge tubes and spark gap switches in which high-voltage discharges are repeated for many hours. The discharge tubes are therefore easily worn and the trigger effect does not last.

SUMMARY OF THE INVENTION

An object of the invention is therefore to provide a discharge tube which overcomes the above-mentioned drawback of easily producing the flashovers and which can maintain a flat and stable frequency characteristic for a long period.

The above objective can be achieved by a discharge tube, which comprises an electrically insulating cylinder sealed with an inert gas; a pair of electrodes disposed facing each other in the insulating cylinder; and an activation layer formed over at least a part of the wall surface exposed to the sealed gas other than the electrode's discharge surface, the activation layer including a silicate compound of alkaline metal.

Such a discharge tube can be manufactured by attaching a silicate compound of alkaline metal to at least a part of the cylinder's inner surface and the electrode surface, other than the discharge surface, that are exposed to the sealed gas; by assembling the cylinder and the electrodes with a bonding agent; and then by heat-treating the assembly to firmly bond the cylinder and the electrodes together.

The activation layer including a silicate compound of alkaline metal that is formed over at least a part of the inner surface exposed to the sealed gas may, for example, be a layer of glass material, which is made of a silicate, an aluminosilicate or a borosilicate including oxides of such alkaline metals as lithium, sodium and potassium. The activation layer may include alkaline earth metals such as barium, strontium and calcium and other oxides.

Such an activation layer may be formed in the following process. A paint containing fine powder of silicate glass, which includes the above-mentioned alkaline metals, is applied to the inner surface of the cylinder, which is then dried and heat-treated for sintering. It is preferable that the heat treatment be done after the cylinder and the electrodes are assembled together with a bonding agent so that the sintering of the activation layer and the bonding together of the cylinder and the electrodes can be carried out simultaneously by the same heat treatment.

In such a discharge tube, the activation layer provided to the inner surface other than the discharge surface that is exposed to the sealed gas is virtually an insulator and thus has little effect on the distribution of electric field enclosing the discharge electrodes. Therefore, the discharge tube of this invention can not only be used the same way as the conventional discharge tubes but has a flat frequency vs. discharge inception voltage characteristic, which remains stable for a long period.

DETAILED DESCRIPTION OF PREFERRED EMBODIMENT

Figure 1:
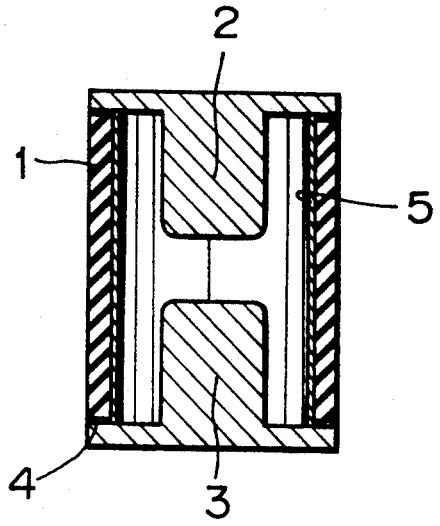
FIG. 1 is a cross section of a discharge tube as one embodiment of the invention.
Figure 2:
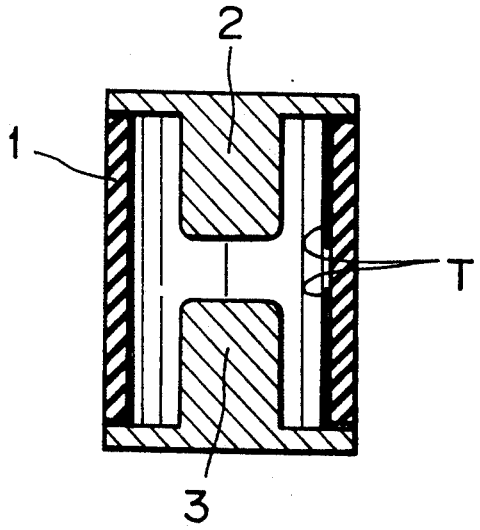
FIG. 2 PRIOR ART
FIG. 2 is a cross section of a conventional discharge tube with a trigger wire.

FIG. 1 shows one example embodiment of a discharge tube according to this invention. Reference numeral 1 represents a cylindrical container formed of an electrically insulating material such as ceramic. Denoted 2 and 3 are discharge electrodes whose apex surfaces are almost flat with rounded edges and which are fixed to the cylindrical container 1 by a glass or metal solder 4. Designated 5 is an activation layer covering the inner wall surface of the cylindrical container 1 which includes silicate compounds of alkaline metal.

The discharge tube of this invention is assembled in the following process. The inner surface of the cylindrical container 1 is applied with a paint, which contains a mixture of water and silicate glass powder of barium soda (ST-W/K of Nippon Denki Glass), and then dried. The discharge electrodes 2, 3 and the cylindrical container 1 are applied with the solder 4 at the jointing surfaces and assembled so that the distance between the opposing electrodes is equal to a specified value. Then, the assembly is put in a vacuum or an inert gas atmosphere where it is heated to fuse the solder 4 and sinter the activation layer 5 at the same time. Now, the discharge tube A is completed.

Figure 3:
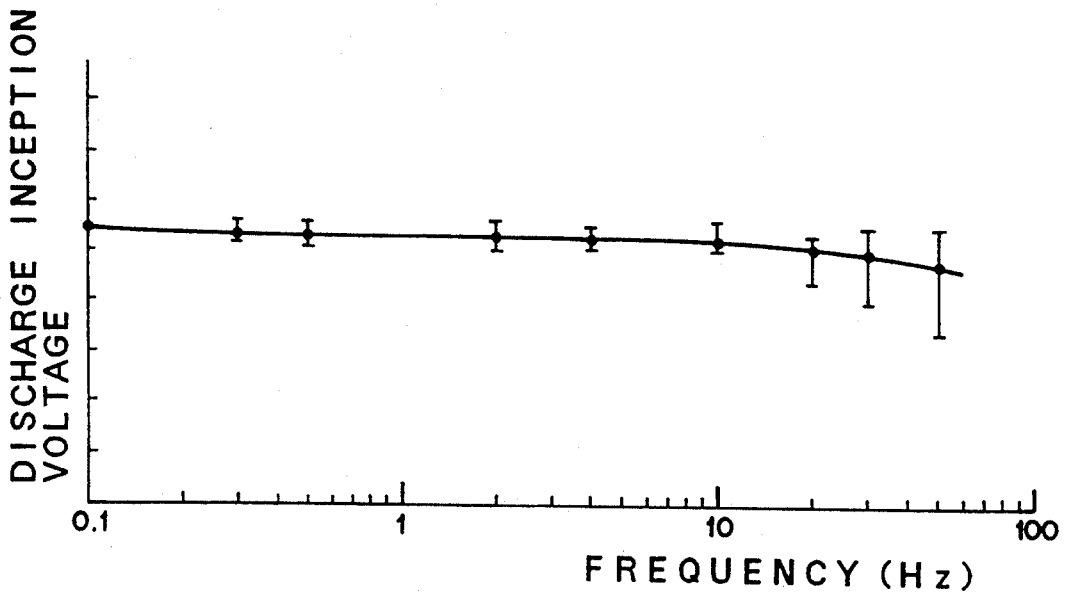
FIG. 3 is a graph of a frequency vs. discharge inception voltage characteristic for the discharge tube of this invention.

Examination of this discharge tube A has shown that it has an ideal, flat frequency vs. discharge inception voltage characteristic, as shown in FIG. 3.

Another discharge tube B was manufactured in the same way as with the above embodiment, except that the activation layer 5 was formed of borosilicate glass powder of soda (7740 of Corning).

The frequency vs. discharge inception voltage characteristic of the discharge tube B is almost the same as the discharge tube A.

A third discharge tube C was manufactured in the same way as with the first embodiment, except that no activation layer 5 was formed.

Figure 4:
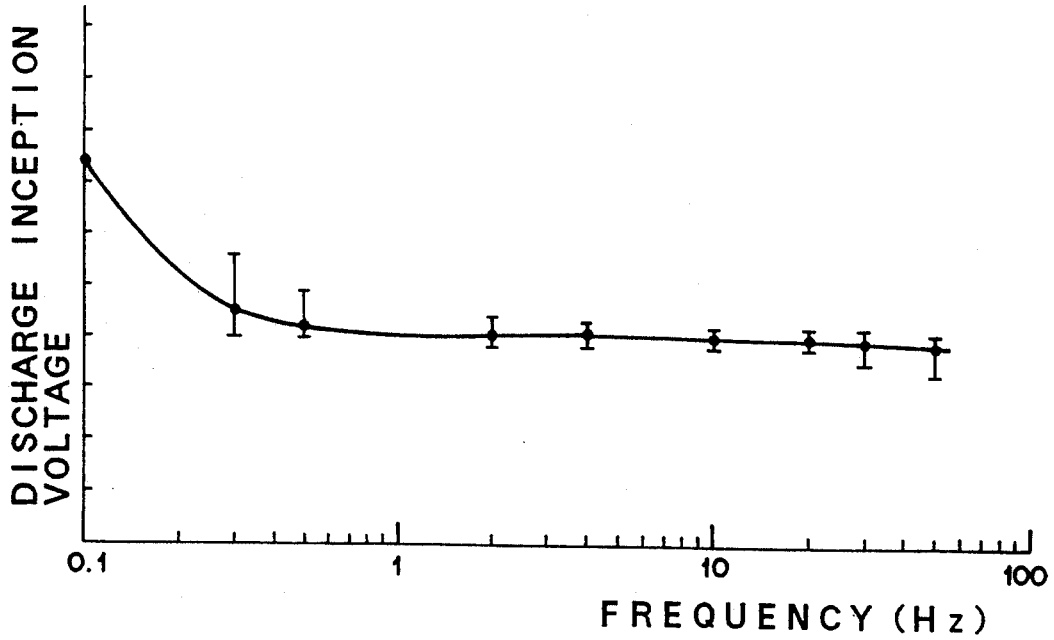
FIG. 4 is a graph of a frequency vs. discharge inception voltage characteristic for the conventional discharge tube.

The frequency vs. discharge inception voltage characteristic of the discharge tube C is as shown in FIG. 4, which indicates that the discharge inception voltage sharply increases as the intervals of discharges increase.

A fourth discharge tube D was made in the same manner as with the first embodiment, except that the activation layer 5 was formed of aluminosilicate glass powder of calcium barium (GA-13 of Nippon Denki Glass).

This discharge tube D has a frequency vs. discharge inception voltage almost identical with that of the third discharge tube C.

A fifth discharge tube E was made in the same manner as with the first embodiment, except that the activation layer 5 was formed of borosilicate glass powder of barium (7059 of Corning).

This discharge tube E has a frequency vs. discharge inception voltage almost identical with that of the third discharge tube C.

As mentioned above, the feature of this invention may be summarizes as follows. The discharge tube of the invention has an activation layer of an alkaline metal silicate compound formed over at least a part of the wall surface, other than the electrode discharge surfaces, that is exposed to the sealed gas. This activation layer ensures a stable discharge inception voltage over a wide range of discharge frequency. This in turn assures a long life of the discharge tube.

What is claimed is:

1. A discharge tube comprising:

an electrically insulating cylinder having first and second open ends;

a pair of electrodes disposed in the first and second open ends facing each other inside the insulating cylinder, each electrode having a discharge surface;

fixing means for fixing said pair of electrodes to said first and second open ends to seal an inert gas therebetween; and an activation layer formed over substantially an inner wall surface of the insulating cylinder and not on the discharge surfaces of the electrodes, said activation layer being exposed to the sealed gas, said activation layer being an insulator which includes a silicate compound of alkaline metal.

2. A discharge tube according to claim 1, wherein said silicate compound of alkaline metal includes a silicate glass of barium soda.

3. A discharge tube according to claim 1, wherein said silicate compound of alkaline metal includes a borosilicate glass of soda.

* * * * *